United States Patent [19]

Gu et al.

[11] Patent Number: 4,804,462

[45] Date of Patent: Feb. 14, 1989

[54] BENEFICIATING DOLOMITIC PHOSPHATE ORES WITH HUMIC ACID

[75] Inventors: Zheng-xing Gu; Shaung-shii Hsieh, both of Florence, Ala.

[73] Assignees: Lian-yun-gang Chemical Mines Research and Design Institute, Lianyungang, China; The Tennessee Valley Authority, Muscle Shoals, Ala.

[21] Appl. No.: 184,223

[22] Filed: Apr. 18, 1988

[51] Int. Cl.[4] ..... B03D 1/02

[52] U.S. Cl. ..... 209/167

[58] Field of Search ..... 209/166, 167, 902; 423/167

[56] References Cited

U.S. PATENT DOCUMENTS

| | | | |
|---|---|---|---|
| 2,564,367 | 8/1951 | LeBaron | 209/166 |
| 2,706,557 | 4/1955 | Houston | 209/166 |
| 3,032,195 | 5/1962 | Fenske | 209/166 |
| 3,032,196 | 5/1962 | Soltin | 209/166 |
| 3,067,875 | 12/1962 | Fenske | 209/166 |
| 3,098,817 | 7/1963 | Baarson | 209/166 |
| 3,099,620 | 7/1963 | Adam | 209/166 |
| 3,782,539 | 1/1974 | Painter | 209/166 |
| 4,309,282 | 1/1982 | Smith | 209/166 |
| 4,317,715 | 3/1982 | Hintikka | 209/166 |
| 4,636,303 | 1/1987 | Hsieh | 209/167 |

OTHER PUBLICATIONS

"Humic Acid"-Kirk Othmer Encyclopedia of Chem. Tech. 2nd edition, vol. 7, 530-539.

*Primary Examiner*—Kenneth M. Schor
*Assistant Examiner*—Thomas M. Lithgow
*Attorney, Agent, or Firm*—Robert A. Petrusek

[57] ABSTRACT

A phosphate ore flotation process for subjecting a phosphate ore containing dolomitic impurities to beneficiation as follows: The flotation feed is first conditioned with fatty acid and fuel oil as collectors and then reconditioned with humic acid as a modifier; subjecting the reconditioned flotation feed to rougher phosphate flotation to collect the rougher phosphate concentrate from the overflow; subjecting said rougher phosphate concentrate to at least one cleaner phosphate flotation; and recovering the phosphate product in the overflow from said cleaner phosphate flotation step.

8 Claims, 1 Drawing Sheet

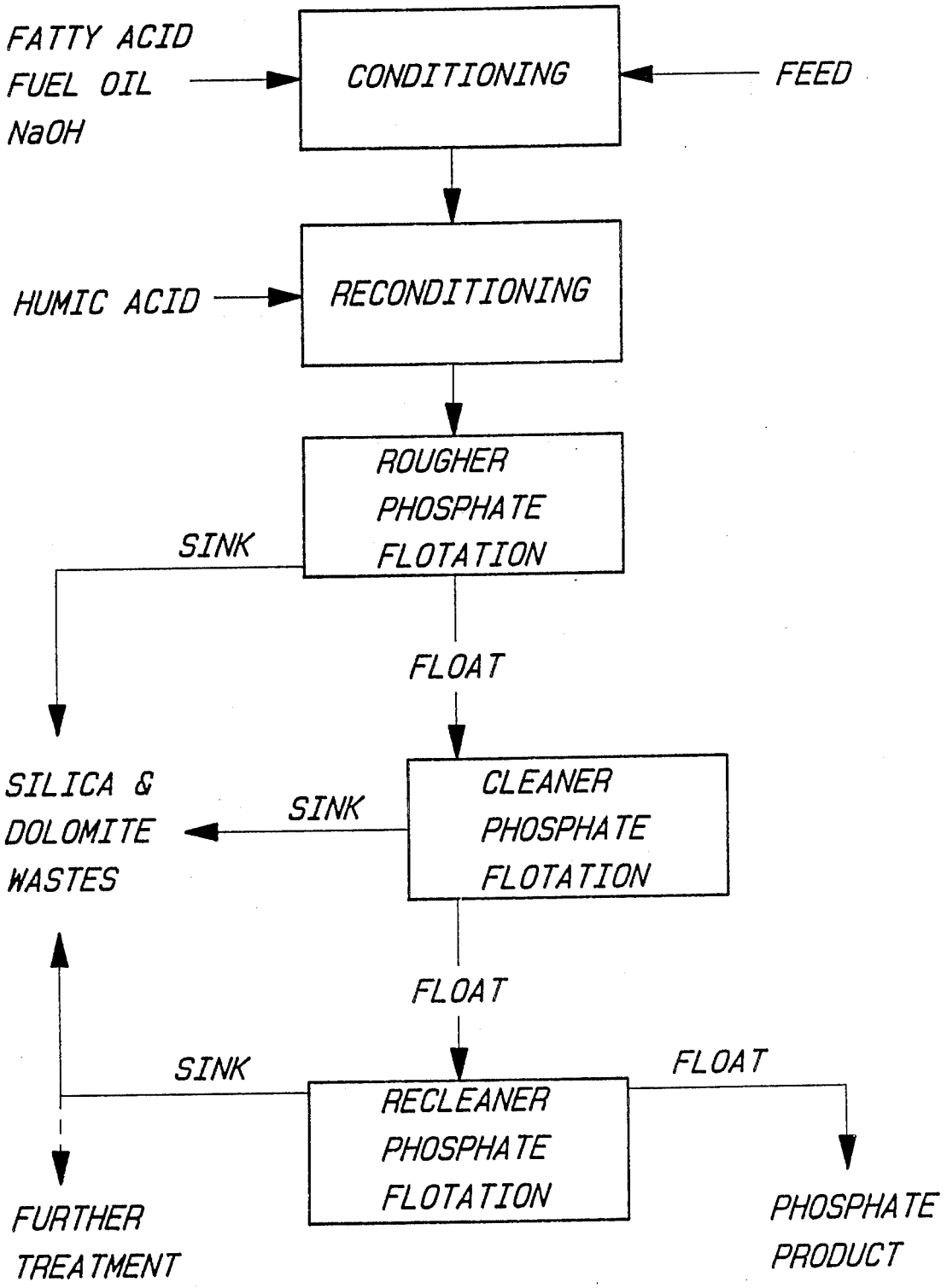
FATTY ACID
FUEL OIL
NaOH
CONDITIONING
FEED
HUMIC ACID
RECONDITIONING
ROUGHER
PHOSPHATE
FLOTATION
SINK
FLOAT
SILICA &
DOLOMITE
WASTES
SINK
CLEANER
PHOSPHATE
FLOTATION
FLOAT
SINK
FLOAT
RECLEANER
PHOSPHATE
FLOTATION
FURTHER
TREATMENT
PHOSPHATE
PRODUCT

BENEFICIATING DOLOMITIC PHOSPHATE ORES WITH HUMIC ACID

The invention herein described may be manufactured and used by or for the Government for governmental purposes without the payment to us of any royalty therefor.

INTRODUCTION

The present invention relates to a phosphate ore beneficiation process and, more particularly, the present invention relates to the use of humic acid as a modifier for beneficiating phosphate ores containing dolomitic impurities, and still more particularly, the present invention relates to a specific sequence of steps, as they relate to use of said humic acid as a modifier and the use of fatty acid as a collector.

BACKGROUND OF THE INVENTION

1. Field of the Invention

Currently practiced processes for beneficiation of phosphate ores commonly utilize flotation as the principal step for separating phosphates from gangue minerals. The "Crago" or "double float" froth flotation process is commercially used for beneficiating such phosphate ores in which silica and silicate minerals are the prodominant constituents of gangues. That process consists of conditioning the material with fatty acids and fuel oil, flotation of phosphate minerals, deoiling with sulfuric acid to remove the reagents, and refloating with amine reagents to remove the siliceous gangue which either floated or was trapped in the rougher float (U.S. Pat. No. 2,293,640).

However, many phosphate ores of potential commercial value contain carbonate gangue mineral matter in addition to siliceous minerals. These carbonate mineral impurities include dolomite, calcite, dolomitic limestone, seashell, and other less common carbonate-type minerals. Such mineral impurities not only dilute the $P_2O_5$ content of the phosphate ore concentrate, but also may interfere in subsequent chemical processing thereof. For example, carbonate minerals present in phosphate ore concentrates used to produce phosphoric acid, superphosphate, or triple superphosphate consume acid reagents in the acidulation steps without providing additional fertilizer values. They aggravate foam formation in the reactor vessel. The presence of dolomite or dolomitic limestone in the phosphate ore concentrate is particularly important because relatively small amounts of magnesium (i.e., $>1$ percent MgO) may cause technical problems in current wet-process acid chemical plants due to increased viscosity of acid, increased defoamer usage, scale and sludge formation, and possibly difficulty in maintaining a standard diammonium phosphate (DAP) fertilizer grade.

The "double float" process has generally been ineffective for beneficiating such high carbonate phosphate ores. Collectors such as fatty acids used for phosphate minerals generally float carbonate minerals as well, and it is only by the employment of suitable selective depressants of either phosphate or carbonate gangue that adequate selectivity can be obtained.

2. Description of the Prior Art

Methods of beneficiating phosphate ores containing carbonate and siliceous gangue materials are described in the following U.S. Pat. Nos.: 3,259,242, Snow, July 1966; 3,462,016, Bushell et at, August 1969; 3,462,017, Bushell et al, August 1969; 3,807,556, Johnston, May 1974; 4,144,969, Snow, March 1979; 4,189,103, Lawver et al, February 1980; 4,287,053, Lehr et al, September 1981; 4,317,715, Kintikka et al, March 1982; 4,364,824, Snow, Dec. 21, 1982; 4,372,843, Lawver et al, February 1983; 4,636,303, Hsieh et al, Jan. 13, 1987; and 4,648,996, Hsieh et al, Mar. 10, 1987. Each of these patents deals with processes that differ from the present invention, as for example: Snow, in U.S. Pat. No. 3,259,242 supra describes the beneficiation of a macro-crystalline apatite-calcite mixture which utilizes a cationic flotation to collect apatite as a float concentrate. Bushell et al, in U.S. Pat. No. 3,462,016 supra, teaches the use of $H_3PO_4$ and Bushell et al in U.S. Pat. No. 3,462,017 supra teach the use of $NH_4H_2PO_4$, both as phosphate mineral depressants for beneficiating carbonate-bearing phosphate rock. Johnston, in U.S. Pat. No, 3,807,556 supra further teaches the use of soluble sulfate salts as $Na_2SO_4$ or $(NH_4)_2SO_4$ to reduce the loss of soluble phosphate in the processes of U.S. Pat. Nos. 3,462,016 and 3,462,107 supra.

The use of an apatite-collecting cationic reagent and a liquid hydrocarbon is described in U.S. Pat. Nos. 4,144,969 and 4,189,103 supra. These patents describe a phosphate ore beneficiating process in which the deslimed ore is first subjected to a "double float" froth flotation as described in U.S. Pat. No. 2,293,640, Crago, Aug. 18, 1942, to remove siliceous gangue. The float product containing apatite with dolomite impurities is then conditioned with a cationic agent and a liquid hydrocarbon to concentrate apatite as float.

Hintikka et al, in U.S. Pat. No. 4,317,715 supra, describe two alternative processes to separate phosphate minerals from carbonate minerals after phosphate and carbonate minerals are concentrated from silicates; (1) the combined phosphate-carbonate concentrate is treated with a base, whereafter phosphate mineral is floated with a cationic collector, or (2) the combined phosphate-carbonate concentrate is treated with SO2 or CO2 to recover phosphate as a float.

Snow in U.S. Pat. No. 4,364,824 and Lawver et al in U.S. Pat. No. 4,364,824 supra, describe a flotation process for removing carbonate mineral impurities. The process employs salts of sulfonated linear fatty acids as a carbonate mineral collector and a phosphate depressant, such as polyphosphate, metaphosphate, pyrophosphate or orthophosphate, to remove carbonate minerals in the overflow and to collect the phosphate concentrate in the underflow.

Lehr et al in U.S. Pat. No. 4,287,053, assigned to the assignee of the present invention, describe a phosphate ore beneficiating process in which phosphate ores containing carbonate mineral impurities are subjected to froth flotation in the presence of phosphate depressants, said depressants comprising alkyl diphosphonic acids, and a carbonate collector, said collector comprising fatty acids, removing the separated carbonate minerals from the overflow, and recovering the phosphate value in the underflow.

Hsieh in U.S. Pat. No. 4,636,303, assigned to the assignee of the present invention, teaches a phosphate ore beneficiating process wherein phosphate ore containing coarse, weathered dolomite in the flotation feed thereof is subjected to a rougher phosphate flotation with fatty acid and fuel oil and wherefrom is removed the coarse, weathered dolomite in one or more cleaner phosphate flotations, without the use of additional flotation reagents added thereto. After the deoiling or acid-wash step, the resulting concentrate is subjected to amine flotation to remove residual silica and/or to carbonate flotation using alkyl diphosphonic acid as depressant and fatty acids as collector, with the phosphate values being recovered in the underflow.

Hsieh in U.S. Pat. No. 4,648,966, assigned to the assignee of the present invention, teaches still further an improved process for beneficiating phosphate ore containing coarse, weathered dolomite in the flotation feed. The teachings thereof introduce the use of two additional steps, i.e., (1) subjecting the float from cleaner phosphate flotation to a sulfuric acid-based partial deoiling step, and (2) subjecting said partial deoiling pulp to a phosphate-carbonate flotation step to collect the first fraction of the phosphate concentrate as underflow. The float is then subjected to total deoiling with sulfuric acid and then to carbonate flotation step using diphosphonic acid as a phosphate mineral depressant and fatty acid as a carbonate mineral collector to recover the remaining phosphate values as underflow.

The present invention teaches a process for beneficiation of dolomitic phosphate ores which is much simpler than those of the prior art. In the practice of the instant invention, the prepared flotation feed is conditioned with fatty acid and fuel oil which is utilized therein as the phosphate mineral collector and then conditioned with humic acid which is utilized therein as the dolomite depressant or modifier. The conditioned flotation feed is then subjected to rougher phosphate flotation to reject both the dolomite and the silica in the underflow or sink and to collect the rougher phosphate concentrate in the overflow or float. The rougher phosphate concentrate is then subjected to one or more cleaner phosphate flotation steps, passes, or stages, without addition thereto of additional flotation reagent, to remove additional silica and dolomite in the underflow. The phosphate product is then recovered as cleaner float. In practice of this instant invention, we have found that a sufficient amount of dolomite impurity is removed in the rougher and cleaner phosphate flotation steps such that no carbonate flotation is required to remove residual dolomite particles as is required in the practice of the teachings in U.S. Pat. Nos. 4,636,303 and 4,648,966 supra.

SUMMARY OF THE INVENTION

The present invention is directed to an improved flotation process for upgrading phosphate ore containing dolomitic mineral impurities, particularly those phosphate ores containing coarse, weathered dolomite in the flotation feed. The said flotation feed may be either the regular flotation feed fraction prepared by the conventional washing and sizing methods, or the flotation feed prepared from the pebble size fraction by conventional grinding and sizing methods known in the art. The method of the subject invention includes the steps of:

(a) conditioning the flotation feed at about pH 8.0 to 10.5 with about 0.3 kg to about 2 kg fatty acid and upwards to about 4 kg fuel oil per ton of feed;

(b) reconditioning the flotation feed from step (a) supra with about 0.05 kg to about 0.5 kg humic acid (100% active conent) per ton of feed;

(c) subjecting reconditioned flotation feed from step (b) supra to rougher phosphate flotation and collecting the phosphate value and some silica and dolomite impurities as rougher concentrate from the overflow;

(d) subjecting said rougher concentrate to one or more cleaner flotations without introducing thereinto additional flotation reagent, and rejecting additional dolomite and some silica in the underflow; and (e) recovering the phosphate product in the overflow of step (d) supra.

The gist underlying the concept of the instant invention is that the practice of step (b), supra, weakens the hydrophobia of dolomite particles to which the fatty acid collector reagent has already been adsorbed, and thereby subsequently enhances the removal of dolomite particles in steps (c) and (d).

OBJECTS OF THE INVENTION

It is, therefore, a principal object of the present invention to provide an improved flotation process with high recovery efficiency and reasonable cost for the beneficiation of phosphate ores containing coarse, weathered dolomite.

Another object of the present invention is to provide an improved flotation process with high recovery efficiency and reasonable cost for the beneficiation of phosphate ores containing coarse, weathered dolomite wherein subsequent to the conditioning of the flotation feed with a fatty acid collector the new, novel, and heretofore unknown flotation modifier is added to weaken the hydrophobicity of the dolomite particles therein, and onto which said fatty acid collector has already been adsorbed thereby substantially enhancing the subsequent removal of said dolomite as underflow or sink in the rougher and cleaner flotation circuit.

Still further and more general objects and advantages of the present invention will appear from the more detailed description set forth below, it being understood, however, that this more detailed description is given by way of illustration and explanation only and not necessarily by way of limitation since various changes therein may be made by those skilled in the art without departing from the true spirit and scope of the present invention.

BRIEF DESCRIPTION OF THE DRAWING

The present invention will be better understood from a consideration of the following description taken in connection with the accompanying drawing in which:

The FIGURE is a flowsheet generally illustrating the preferred embodiment and procedures followed for the practice of the instant invention.

DESCRIPTION OF THE PREFERRED EMBODIMENTS IN CONJUNCTION WITH A DETAILED DESCRIPTION OF THE FIGURE

The present invention provides an improved beneficiation process for concentrating phosphate values from phosphate ores containing coarse, weathered dolomite in the flotation feed, such as for example, that found in sedimentary deposit in central and south Florida. The flotation feed can be regular flotation feed fraction prepared from the dolomitic phosphate ore by the conventional washing and sizing methods, or the flotation feed prepared from the pebble size fraction of dolomitic phosphate ores by conventional grinding and sizing techniques known in the art. A particle size smaller than about 28 mesh is preferably used as the flotation feed for the present flotation process comprising the instant invention. With larger particle size, an appreciable amount of the gangue minerals may remain locked with the phosphate minerals. Furthermore, the larger particles are difficult to float. Very small particles, e.g., smaller than 400 mesh, are removed by the conventional desliming process. Although the slime may contain phosphate values, their relatively large consumption of reagent make their beneficiation economically unattractive in relation to recoverable value of $P_2O_5$ therein.

The general flotation procedure used in the present invention is shown in the FIGURE. The prepared flotation feed, which is about −28 and +400 mesh in size and can be as large as minus 16 mesh, but preferably no larger than about minus 28 mesh, is conditioned within the general range of about 20 to 75 percent solids content, said solids content preferably ranging between about 60 to about 70 percent, and at about pH 8 to 11, said pH preferably being between about 8.5 and 10, with about 0.3 kg to about 2 kg fatty acid, said fatty acid preferably being between about 0.6 and about 1.5 kg, and upwards to about 4 kg fuel oil, said fuel oil preferably being between about 0.2 to about 3.0 kg, per ton of feed as collectors. The conditioned feed, supra, is then reconditioned with from about 0.05 kg to about 0.5 kg, preferably between about 0.1 and about 0.2 kg, humic acid (100% active content) per ton of feed as a modifier. After reconditioning, the feed is diluted with water. The phosphate values with some silica and dolomite impurities are then collected from the overflow as rougher concentrate. The rougher concentrate, supra, is then subjected to one or more cleaner flotation(s) (i.e., steps, passes, or stages), by returning the said rougher concentrate to the flotation cell, diluted with water and refloated to collect phosphate concentrate as overflow. The underflow from the cleaner flotation(s) is rejected as waste, or may be subjected to further processing to collect additional phosphate values using any number of standard techniques presently known in the art, such as by returning said cleaner underflow to the rougher flotation circuit, or by subjecting said cleaner underflow to further processing using other known flotation methods.

It should be appreciated by those skilled in this art that there are many variations of the instant invention which can be used to adapt the process for most efficient use for recovery of the phosphate values from a particular phosphate ore. The gist of the concept underlying the principal thrust of the present invention, is that the humic acid is used as the modifier after the flotation feed is conditioned with fatty acid collector so that the humic acid can effect a weakening of the hydrophobicity of the dolomite particles to which the fatty acid collector has already been adsorbed and thereby enhance the subsequent removal of dolomite particles as underflows in the rougher and cleaner phosphate flotation circuits. Humic acid may also be added in the cleaner phosphate flotation circuit if so desired. We have found that if the critical feature of the instant invention, as it relates to the proper sequence of humic acid addition is not practiced, and the humic acid is employed in conventional order normally dictated by prior art conventions, i.e., humic acid is added before the flotation feed is conditioned with the fatty acid collector then the humic acid acts to depress both the phosphate and the dolomitic minerals and both the resulting selectivity and the recovery from a process so practiced are very poor.

EXAMPLES

The present invention is further illustrated by the following examples. In order that those skilled in the art may better understand how the present invention can be practiced, the following examples are given by way of illustration only and not necessarily by way of limitation. It should be noted that Example IV herein is offered in the manner of comparative example, in that it illustrates what happens when the critical order or sequence of steps of the instant invention are not practiced, as for example, when humic acid was added before the addition of the fatty acid collector.

EXAMPLE I

A Florida phosphate ore containing dolomite in the pebble fraction was used in this example. The pebble fraction was stage-ground in a rod mill to prepare a minus 28- plus 400-mesh flotation feed. This feed contained about 38 percent CaO, 23 percent $P_2O_5$, 1.9 percent MgO, and 22 percent $SiO_2$. In this flotation experiment, a 520-gram sample was scrubbed at about 50 percent solids content for 5 minutes and then screened to remove the minus 400-mesh slime fraction (about 4%). The deslimed feed (about 500 grams) then was processed by means of the steps of the method shown in the FIGURE. The sample was first conditioned at a pulp density of 65 percent solids for 1 minute with 0.15 MaOH per ton of feed, for an additional 2 minutes with 0.75 kg fatty acid and 1.5 kg fuel oil per ton of feed. After the pulp conditioned with fatty acid and fuel oil collector, the pulp was then reconditioned for 2 minutes with 1.0 kg Enhance THA per ton of feed (Enhance THA is the tradename of commercially available humic acid salts which contain 12 percent active ingredient). NOTE: Any reference made herein to materials and/or apparatus which are identified by means of trademarks, tradenames, etc., are included solely for the convenience of the reader and are not intended, or to be construed, as an endorsement of said materials and/or apparatus. At end of reconditioning with Enhance THA humic acid, the pH was 9.5. After reconditioning, the pulp then was diluted with tap water and floated to recover the phosphate values in the rougher float and to remove silica and some dolomite as waste in the rougher sink.

After the rougher phosphate flotation, the rougher phosphate concentrate was returned to the flotation cell, diluted with tap water and refloated with the phosphate minerals in the float and the rejected dolomite and some silica in the sink. The same cleaner phosphate flotation procedure was repeated once to remove additional dolomite and silica as waste in the sink and to recover the phosphate product in the float. The flotation results are shown in Table I infra. The final phosphate product contained 31.0 percent $P_2O_5$ and 1.0 percent MgO. The $P_2O_5$ recovery was 84.2 percent.

TABLE I

| | | Analysis, % | | | | Distribution, % | | | |
|---|---|---|---|---|---|---|---|---|---|
| Product | wt % | CaO | $P_2O_5$ | MgO | $SiO_2$ | CaO | $P_2O_5$ | MgO | $SiO_2$ |
| Rougher Sink | 21.61 | 8.2 | 3.1 | 2.3 | 78.5 | 4.6 | 2.9 | 27 | 77.3 |
| Cleaner Sink | 8.19 | 35.8 | 16.5 | 6.0 | 20.3 | 7.7 | 5.8 | 26 | 7.6 |
| Recleaner Sink | 6.92 | 41.8 | 23.7 | 3.2 | 11.5 | 7.5 | 7.1 | 12 | 3.6 |

TABLE I-continued

| Product | wt % | Analysis, % | | | | Distribution, % | | | |
|---|---|---|---|---|---|---|---|---|---|
| | | CaO | $P_2O_5$ | MgO | $SiO_2$ | CaO | $P_2O_5$ | MgO | $SiO_2$ |
| Recleaner Float | 63.28 | 48.5 | 31.0 | 1.0 | 4.0 | 80.2 | 84.2 | 35 | 11.5 |
| Head | 100.00 | 38.3 | 23.3 | 1.9 | 21.9 | 100.0 | 100.0 | 100 | 100.0 |

EXAMPLE II

In the tests comprising this example the phosphate ore flotation feed and flotation procedure were the same as that outlined in Example I supra, except that Enhance THA humic acid (12% active ingredient) used was decreased to 0.75 kg per ton of feed. The flotation results are shown in Table II infra. The recovered phosphate product contained 30.8 percent P2O5 and 1.0 percent MgO. The $P_2O_5$ recovery was 85.2 percent.

TABLE II

| Product | wt % | Analysis, % | | | | Distribution, % | | | |
|---|---|---|---|---|---|---|---|---|---|
| | | CaO | $P_2O_5$ | MgO | $SiO_2$ | CaO | $P_2O_5$ | MgO | $SiO_2$ |
| Rougher Sink | 21.77 | 8.4 | 3.1 | 2.4 | 75.0 | 4.7 | 2.9 | 28 | 76.9 |
| Cleaner Sink | 7.79 | 36.5 | 17.4 | 5.7 | 18.4 | 7.4 | 5.8 | 24 | 6.8 |
| Recleaner Sink | 6.21 | 41.5 | 22.8 | 3.9 | 12.5 | 6.7 | 6.1 | 13 | 3.7 |
| Recleaner Float | 64.23 | 48.6 | 30.8 | 1.0 | 4.1 | 81.2 | 85.2 | 35 | 12.6 |
| Head | 100.00 | 38.5 | 23.2 | 1.9 | 21.2 | 100.0 | 100.0 | 100 | 100.0 |

EXAMPLE III

As noted in the last example, in the tests comprising this example the phosphate ore flotation feed and flotation procedure were the same as that outlined in Example I supra, except that Enhance THA humic acid (12% active ingredient) used was increased to 1.25 kg per ton of feed. The flotation results are shown in Table III infra. The recovered phosphate product contained 31.3 percent $P_2O_5$ and 1.0 percent MgO. The $P_2O_5$ recovery was 83.5 percent.

TABLE III

| Product | wt % | Analysis, % | | | | Distribution, % | | | |
|---|---|---|---|---|---|---|---|---|---|
| | | CaO | $P_2O_5$ | MgO | $SiO_2$ | CaO | $P_2O_5$ | MgO | $SiO_2$ |
| Rougher Sink | 22.10 | 7.8 | 2.8 | 2.5 | 79.2 | 4.6 | 2.7 | 28 | 77.2 |
| Cleaner Sink | 7.25 | 33.4 | 15.9 | 6.0 | 23.4 | 6.4 | 5.0 | 23 | 7.5 |
| Recleaner Sink | 8.79 | 41.2 | 23.1 | 3.9 | 12.2 | 9.6 | 8.8 | 17 | 4.7 |
| Recleaner Float | 61.86 | 48.2 | 31.1 | 1.0 | 3.9 | 79.4 | 83.5 | 32 | 10.6 |
| Head | 100.00 | 37.6 | 23.1 | 1.9 | 22.7 | 100.0 | 100.0 | 100 | 100.0 |

EXAMPLE IV

In the testing procedure followed in gathering the data set forth in this comparative example, the phosphate ore flotation feed and amount of reagent dosage were the same as that outlined in Example I, supra, but the sequence procedure of reagent dosage was intentionally reversed to better illustrate the critical nature thereof. The flotation feed was first conditioned for 1 minute with 0.15 kg NaOH and for 2 minutes with 1.0 kg Enhance THA humic acid (12% active ingredient) per ton of feed, and then reconditioned for 2 minutes with 0.75 kg fatty acid and 1.5 kg fuel oil per ton of feed. After reconditioning, the pulp then was subjected to rougher flotation, cleaner flotation, and recleaner flotation as in the procedure followed in Example I, supra, The flotation results are shown in Table IV infra. The final phosphate product contained 29.3 percent $P_2O_5$ and 1.3 percent MgO. The $P_2O_5$ recovery was 38.5 percent. It is quite evident that both grade and $P_2O_5$ recovery of this experiment are inferior to those obtained in Example I supra.

TABLE IV

| Product | wt % | Analysis, % | | | | Distribution, % | | | |
|---|---|---|---|---|---|---|---|---|---|
| | | CaO | $P_2O_5$ | MgO | $SiO_2$ | CaO | $P_2O_5$ | MgO | $SiO_2$ |
| Rougher Sink | 27.03 | 16.3 | 8.4 | 2.5 | 57.9 | 12.7 | 10.2 | 37 | 69.4 |
| Cleaner Sink | 14.83 | 39.4 | 23.2 | 2.4 | 16.1 | 16.9 | 15.6 | 19 | 10.6 |
| Recleaner Sink | 29.20 | 37.4 | 27.0 | 1.4 | 9.7 | 31.5 | 35.7 | 23 | 12.6 |
| Recleaner Float | 28.94 | 46.6 | 29.3 | 1.3 | 5.8 | 38.9 | 38.5 | 21 | 7.4 |
| Head | 100.00 | 34.7 | 22.1 | 1.8 | 22.5 | 100.0 | 100.0 | 100 | 100.0 |

INVENTION PARAMETERS

After sifting and winnowing through the data herein presented, as well as other results and operations of our novel process for beneficiation of dolomitic phosphate ores, the operating and preferred parameters and variables for flotation separation of the present invention are shown in the following tabulation.

Tabulation of Parameters

| Variables | Operating Range | Preferred Range |
|---|---|---|
| Feed Size | −16 mesh +400 mesh | −28 mesh +200 mesh |
| Conditioning pH | 8–11 | 8.5–10 |
| Conditioning density (solid) | 20–74% | 60–70% |
| Fatty acid, kg/ton | 0.3–2 | 0.6–1.5 |
| Fuel oil, kg/ton | 0–4 | 0.2–3 |
| Humic acid (active), kg/ton | 0.05–0.5 | 0.1–0.2 |

While we have shown and described particular embodiments of our invention, modifications and variations thereof will occur to those skilled in the art. We wish it to be understood, therefore, that the appended claims are intended to cover such modifications and variations which are within the true scope and spirit of our invention.

What we claim as new and desire to secure by Letters Patent of the United States is:

1. An ore beneficiation process which comprises the steps of:

(a) subjecting, within a pH ranging from about 8.0 to about 11, a phosphate ore containing phosphate values and dolomitic and silica impurities to a conditioning step in the presence of from about 0.3 kg to about 2 kg of fatty acid and in amounts ranging upwards to about 4 kg of fuel oil, said weight of acid and oil based on each ton of said phosphate ore;

(b) subjecting said conditioned flotation feed from step (a) supra, to a reconditioning step in the presence of from about 0.05 kg to about 0.5 kg of humic acid, said weight of humic acid or salt thereof based on the amount of active contents in the humic acid or salt thereof to each ton of said phosphate ore to form a rougher phosphate flotation feed;

(c) subjecting said reconditioned feed from step (b) supra, to a rougher phosphate flotation and;

(1) collecting substantially the phosphate values therein as rougher phosphate concentrate from the float; and (2) rejecting substantial amounts of silica and domomite impurities in the sink; and (d) subjecting said phosphate rougher concentrate collected in step (c)(1) supra, to at least one cleaner flotation step and;

(1) rejecting residual silica and dolomite in the sink thereof; and (2) recovering in the float therefrom a phosphate product.

2. The process of claim 1 wherein said phosphate ore, utilized as rougher flotation feed, is of a size fraction minus 16-mesh plus 400-mesh.

3. The process of claim 2 wherein said humic acid or salt thereof comprises sodium, potassium, and/or ammonium salts thereof.

4. The process of claim 3 wherein the phosphate ore is adjusted with predetermined amounts of aqueous media for treatment in said conditioning step to a conditioning density ranging from about 20 to about 74 percent solids.

5. The process of claim 1 wherein step (a) thereof the pH ranges from about 8.5 to about 10, the amount of fatty acid ranges from about 0.6 kg to about 1.5 kg, and the amount of fuel oil ranges from about 0.2 to about 3 kg, and wherein step (b) thereof the amount of humic acid or salt thereof ranges from about 0.1 kg to about 0.2 kg.

6. The process of claim 5 wherein said phosphate ore, utilized as rougher flotation feed, is of a size fraction minus 28-mesh plus 200-mesh.

7. The process of claim 6 wherein said humic acid or salt thereof comprises sodium, potassium, and/or ammonium salts thereof.

8. The process of claim 7 wherein the phosphate ore is adjusted with predetermined amounts of aqueous media for treatment in said conditioning step to a conditioning density ranging from about 60 to about 70 percent solids.

* * * * *